US008095313B1

(12) United States Patent
Blackburn

(10) Patent No.: US 8,095,313 B1
(45) Date of Patent: Jan. 10, 2012

(54) METHOD FOR DETERMINING COLLISION RISK FOR COLLISION AVOIDANCE SYSTEMS

(75) Inventor: Michael R. Blackburn, Encinitas, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 870 days.

(21) Appl. No.: 12/144,019

(22) Filed: Jun. 23, 2008

(51) Int. Cl.
*G08G 1/16* (2006.01)

(52) U.S. Cl. ..... 701/301; 701/300; 701/302; 180/271; 180/274; 340/435; 340/436

(58) Field of Classification Search ..... 701/301, 701/300, 302; 180/271, 274; 340/435, 436
See application file for complete search history.

(56) References Cited

U.S. PATENT DOCUMENTS

| | | | | |
|---|---|---|---|---|
| 5,467,072 | A | 11/1995 | Michael | |
| 6,820,006 | B2 * | 11/2004 | Patera | 701/301 |
| 6,859,731 | B2 | 2/2005 | Takafuji et al. | |
| 6,889,786 | B2 | 5/2005 | Watanabe et al. | |
| 7,016,783 | B2 | 3/2006 | Hac et al. | |
| 7,966,127 | B2 * | 6/2011 | Ono et al. | 701/300 |
| 2005/0273263 | A1 * | 12/2005 | Egami et al. | 701/301 |
| 2007/0288133 | A1 * | 12/2007 | Nishira et al. | 701/23 |

OTHER PUBLICATIONS

Fiorini, P. and Schiller, Z., Motion Planning in Dynamic Environments Using the Relative Velocity Paradigm, Journal, 1993, pp. 560-565, vol. I, Proceedings of the IEEE International Conference on Automation.

Fiorini, P. and Schiller, Z., Motion Planning in Dynamic Environments Using Velocity Obstacles, Journal, 1998, pp. 760-772, vol. 17, International Journal of Robotics Research.

Yung N,H,C, and Ye, C., Avoidance of Moving Obstacles Through Behavior Fusion and Motion Prediction, Journal, 1998, pp. 3424-3429, Proceedings of IEEE International Conference on Systems, Man, and Cybernetics, San Diego, California.

Fujimori, A. and Tani, S., A Navigation of Mobile Robots with Collision Avoidance for Moving Obstacles, Journal, 2002, pp. 1-6, IEEE ICIT'02, Bangkok, Thailand.

* cited by examiner

*Primary Examiner* — Yogesh C Garg
*Assistant Examiner* — Anne Georgalas
(74) *Attorney, Agent, or Firm* — Arthur K. Samora; Kyle Eppele

(57) ABSTRACT

Disclosed is a method and apparatus for determining the risk of an object collision. The method includes transmitting a signal and analyzing a received signal that is indicative of the presence of a remote object. The signal is then analyzed to determine an initial azimuth value and an initial range for the remote object. Subsequent received signals are continuously analyzed to continuously determine subsequent azimuth values, azimuth value velocities and accelerations, as well as subsequent range values, range value velocities and range value accelerations. The factors are then input into a predetermined formula to yield a risk assessment of collision P. The formulas for determining P can be adjusted to account for such factors as number and proximity of remote objects, as well as the speed and maneuverability of both the remote objects and the vehicle that is avoiding collisions with the remote object(s).

3 Claims, 5 Drawing Sheets

METHOD FOR DETERMINING COLLISION RISK FOR COLLISION AVOIDANCE SYSTEMS

FEDERALLY-SPONSORED RESEARCH AND DEVELOPMENT

This project (Navy Case No. 98,408) was developed with funds from the United States Department of the Navy. Licensing inquiries may be directed to Office of Research and Technical Applications, Space and Naval Warfare Systems Center, San Diego, Code 2112, San Diego, Calif., 92152; telephone (619) 553-2778; email: T2@spawar.navy.mil.

FIELD OF THE INVENTION

Disclosed is a method for automatically determining the risk of object collisions between a vehicle and a foreign object. The method is intended to work when either the host vehicle or the remote object is moving, or when both the host vehicle and remote object are moving. The method is intended to work with either active or passive target range and direction sensing devices.

SUMMARY OF THE INVENTION

A method of determining the risk of an object collision includes the steps of sequentially analyzing the change in range and azimuth (direction) of a remote object with reference to the host vehicle. If an active sensor is employed, the steps include transmitting a first signal at a predetermined azimuth and receiving a first reflected signal that is indicative of the presence of at least one remote object; analyzing the first reflected signal to determine an initial azimuth value for the remote object and coincidentally determining an initial distance value of the remote object. Second and subsequent signals are transmitted at predetermined time intervals, which results in receipt of second reflected signals and subsequent reflected signals that are indicative of the continued presence of at least the same remote object; the sequentially received reflected signals are further analyzed to continuously determine secondary azimuth values and to continuously determine secondary distance values at the predetermined time intervals. If a passive sensor is employed in which no signal is transmitted from the host to the target, some additional mechanism must be used to assess range. One such mechanism could be to acquire a second signal in parallel with the first target signal, such as in stereo vision. Otherwise the processing steps for a passive sensor are the same as for an active sensor.

For both active and passive sensors, the method steps continue with analyzing the sequential azimuth values and the correlated sequential distance values to determine an azimuth velocity, an azimuth acceleration, a distance velocity and a distance acceleration. The methods include determining a risk of collision P of the vehicle with the remote object. P is determined using a predetermined formula that is based on a combination of the distance, the distance value velocity, the distance value acceleration. the azimuth value velocity and the azimuth value acceleration. P includes a constant scaling constant $\gamma$ that is chosen by the user.

All objects with collision risk assessment above a predetermined value of P pose no immediate collision risk regardless of azimuth. Among objects having a value of P that indicates a range decrease (indicative of an approach), objects with range change decelerations or with relative changes in azimuth pose a low collision risk. Other objects having an assessed collision risk P above a predetermined value pose a higher collision risk. Objects with constant or accelerating range decreases and constant or decelerating azimuth changes pose the highest collision risk.

BRIEF DESCRIPTION OF THE DRAWINGS

The subject matter is herein described, by way of example only, with reference to the accompanying drawings in which similarly-referenced characters refer to similarly-referenced parts, and wherein.

DETAILED DESCRIPTION OF THE EMBODIMENTS

The present embodiments herein are not intended to be exhaustive or to limit in any way the scope of the subject matter; rather they are used as examples for the clarification of the subject matter and for enabling others skilled in the art to utilize its teaching. The word "exemplary" is used herein to mean "serving as an example, instance, or illustration." Any embodiment described herein as "exemplary" is not necessarily to be construed as preferred or advantageous over other embodiments.

Because neither range information nor azimuth information alone are adequate to assess collision risk between a moving vehicle and an obstacle, the method of this invention uses the first and second derivatives of the relative range of a detected object with respect to time (relative velocity and acceleration respectively) in combination with change in object azimuth as sensed by the host platform to determine the risk that the object and host will collide. This method involves a short time history of sensor samples and makes valid risk assessments only for the behavior of the objects relative to the host over that history. The laws of physics extend the validity of the risk assessments forward in time as a function of object mass, velocity and intervening forces. Knowledge of these forces, however, is unnecessary to determine if the host vehicle sensor continues to accumulate target object information, i.e., a detected object's relative changes in range and azimuth with respect to time, continually updating the risk assessments. This method applies to both moving and static objects as follows: among objects demonstrating absolute range decreases (indicative of an approach), objects with range change decelerations or with relative changes in azimuth pose a low collision risk, while the remainder poses a higher collision risk. Objects with constant or accelerating range decreases and constant azimuths pose the highest collision risk.

Figure 1:
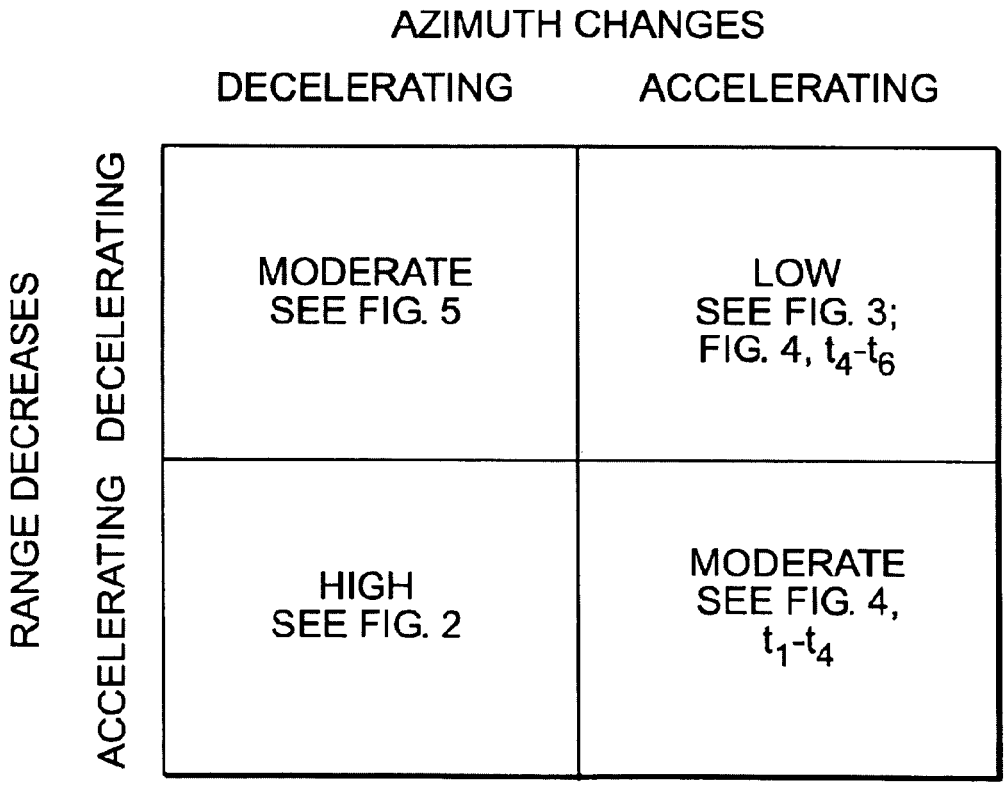
FIG. 1 is a chart displaying collision risk as a function of range decreases and azimuth stability.

FIG. 1 summarizes the consequences of the four possibilities of range decreases and azimuth stability. Collision risk will be high when azimuth changes are either constant or decelerating and range decreases are either constant or accelerating, while collision risk will be low when azimuth changes are accelerating and range decreases are decelerating. Collision risk will be moderate under all other conditions or range decreases.

FIGS. 2-5 provide examples of these possibilities in two dimensions. All objects with range increases (indicative of relative departures or of increasing separations) pose little collision risk regardless of azimuth. These predictions apply to objects located at all ranges and azimuths relative to the host. Within the above conditions, for a given host vehicle with finite ability to overcome inertia and avoid high risk collisions, the collision risk of an approaching object is proportional to closing velocity and inversely proportional to absolute range. These predictive rules are valid in three spatial dimensions as well, when elevation is measured and treated in addition to azimuth as a conditional factor.

Figure 2:
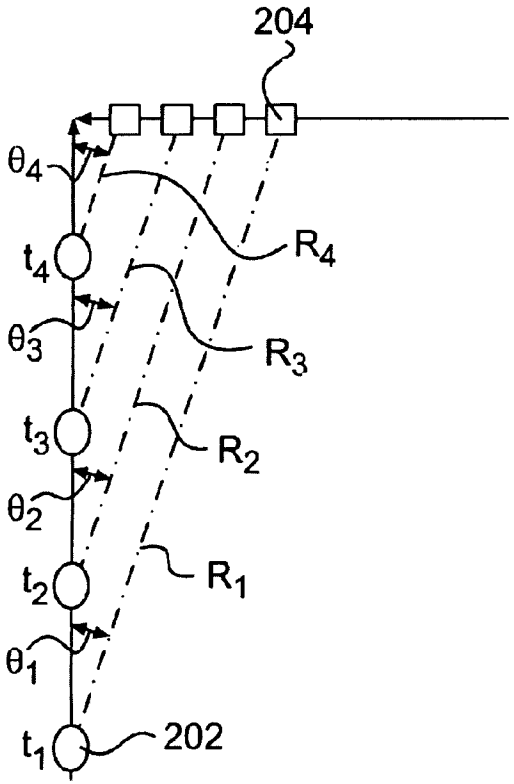
FIG. 2 shows an imminent risk of collision with a detected target vehicle that is proceeding at a constant azimuth with constant range decreases.

FIG. 2 shows a remote object 204 and a host vehicle 202 approaching each other at right angles. Both vehicles are moving at constant velocity, although the host vehicle is traveling at approximately 2.3 times the velocity of the target vehicle. The constant change in range $R_i$ at times $t_i$ between the host vehicle 202 and the remote object 204 and the constant azimuth angle Θ of the remote object with respect to the host vehicle indicate a high collision risk. Distance versus angle values are provided in Table 2 (All values presented in the Tables below are generic unit values for time, azimuth and range, which can be chosen according to the user):

TABLE 2

| Time | Range | Range delta | Azimuth |
|---|---|---|---|
| $t_1$ | 30.7 | | 23.6 |
| $t_2$ | 22.8 | 7.9 | 23.6 |
| $t_3$ | 14.9 | 7.9 | 23.6 |
| $t_4$ | 7.0 | 7.9 | 23.6 |

Figure 3:
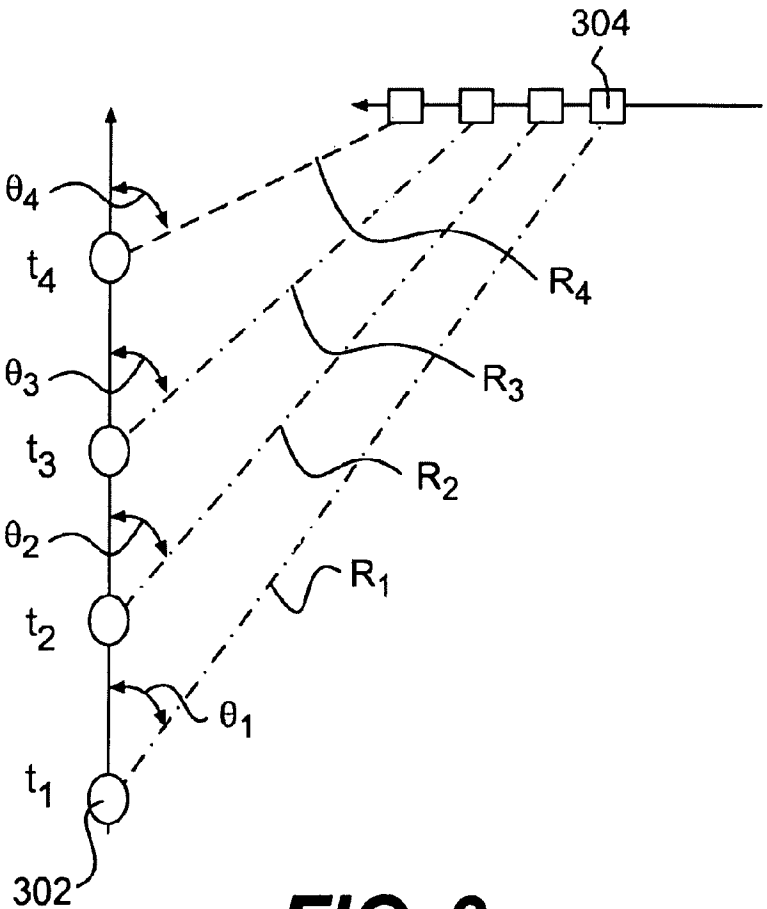
FIG. 3 shows a low risk of collision with a detected target vehicle having a changing azimuth with decelerating range decreases.

FIG. 3 is similar to FIG. 2 except that the remote object 304, due to its greater distance from the host vehicle 302, produces very different sensor information at the host vehicle. The change in range R decreases with each time sample indicating a deceleration in range changes, but the azimuth of the target increases further indicating that the host vehicle will pass safely in front of the target vehicle as it crosses the intersection. FIG. 3, in coincidence with Table 3, illustrates an example of a low collision risk situation.

TABLE 3

| Time | Range | Range delta | Azimuth |
|---|---|---|---|
| $t_1$ | 36.8 | | 42.8 |
| $t_2$ | 29.7 | 7.1 | 45.0 |
| $t_3$ | 22.7 | 7.0 | 48.6 |
| $t_4$ | 15.8 | 6.9 | 53.1 |

Figure 4:
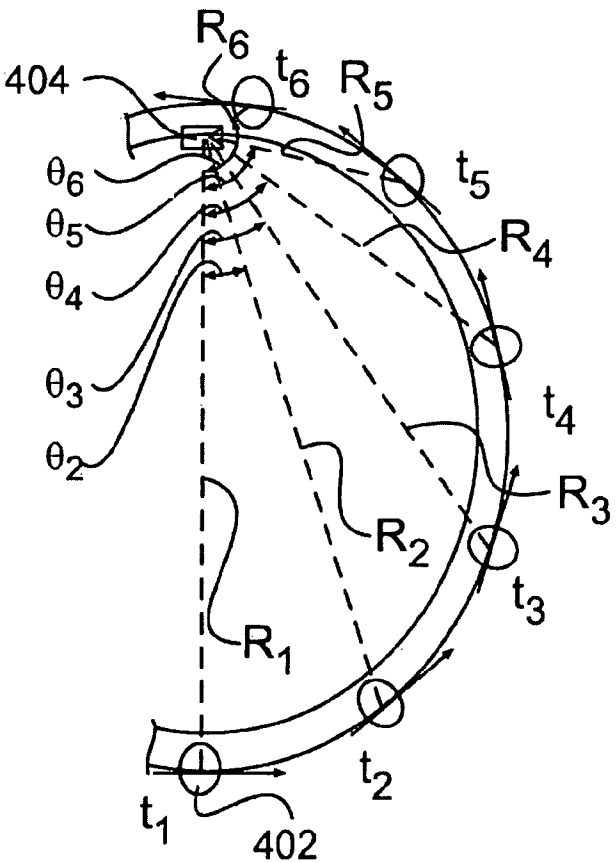
FIG. 4 is a depiction showing the uncertainty of collision risk between two approaching vehicles on a curve, and the resolution of that uncertainty as the azimuth change reverses direction between $t_4$ and $t_6$.

FIG. 4 shows two vehicles approaching on a two-lane curved road. Because the sensor is providing only relative range and azimuth information, and because the radius of curvature is constant, the location of the target vehicle is represented as static and only the host vehicle is shown to be moving. Due to the curvature of the road, in the first four of the sensor returns ($R_1$-$R_4$), the range R decreases accelerate and the azimuth angle ($\Theta_1$-$\Theta_4$) changes indicate a movement of the target toward the direction of travel of the host vehicle. This would indicate a moderate collision risk. However, as the two vehicles approach closer on the two-lane road, the lateral offset of the lanes begins to have a noticeable effect on the range acceleration and on the direction of change in target azimuth. Between $t_4$ and $t_6$, the range decelerates and the azimuth angle Θ increases indicating a low risk of collision. Sensor returns are provided in table 4:

TABLE 4

| Time | Range | Range delta | Theta | Theta delta |
|---|---|---|---|---|
| $t_1$ | 1600 | | −90.0 | |
| $t_2$ | 1514 | −86 | −71.3 | 18.7 |
| $t_3$ | 1263 | −251 | −52.7 | 18.6 |
| $t_4$ | 878 | −385 | −34.4 | 18.3 |
| $t_5$ | 397 | −354 | −17.2 | 17.2 |
| $t_6$ | 53 | −344 | −24.0 | −6.8 |

Figure 5:
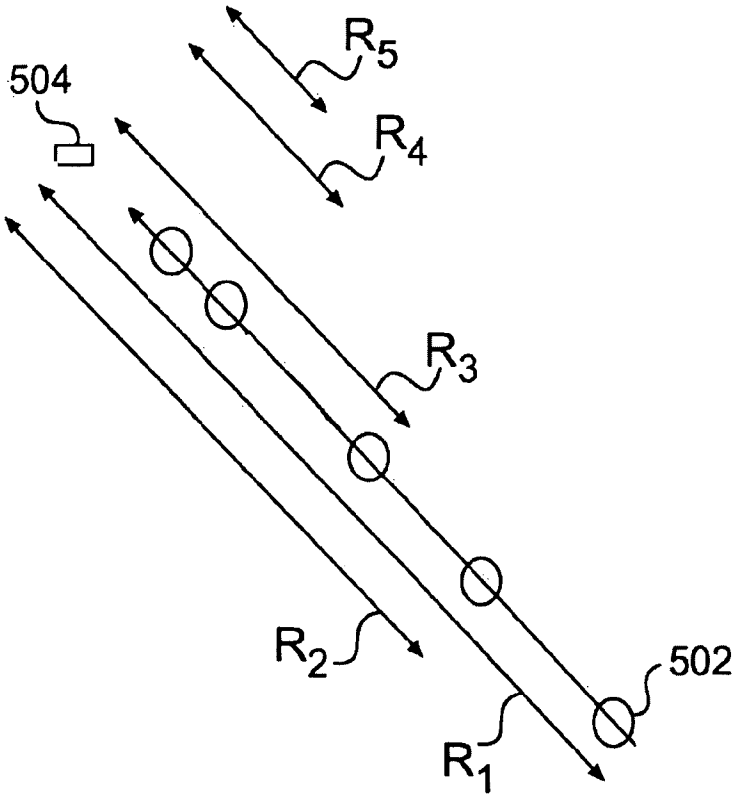
FIG. 5 shows a moderate risk of collision with a detected vehicle based on decelerating range decreases and a constant azimuth.

FIG. 5 presents the simple case in which the host 502 vehicle is approaching a static target 504, such as a vehicle stopped at an intersection. The host vehicle is decelerating while the target azimuth remains constant at zero degrees (head-on). The collision risk is moderate under these conditions as the target behavior cannot be predicted with certainty. The host vehicle can assess its deceleration and remaining target range to determine if these two parameters will permit collision avoidance under the present circumstances. Sensor returns are provided in table 5:

TABLE 5

| time | range | delta range | theta |
|---|---|---|---|
| $t_1$ | 315 | | 0 |
| $t_2$ | 228 | 87 | 0 |
| $t_3$ | 158 | 70 | 0 |
| $t_4$ | 105 | 53 | 0 |
| $t_5$ | 70 | 35 | 0 |
| $t_6$ | 53 | 17 | 0 |
| $t_7$ | 53 | 0 | 0 |

When two vehicles approach each other on a straight two-lane road, the approach velocity is increasing because of the acceleration of one or both velocity values. Because the two vehicles are on different tracks (traffic lanes) the lateral separation creates a change in relative azimuth from 0 to 90 degrees as the vehicles approach, and from 90 to 180 degrees as they pass, and creates a deceleration in the range changes in the last range samples. This information predicts a low collision risk. Similar information would result from the host vehicle passing parked vehicles, road-side signs, posts, and pedestrians, even as the host vehicle accelerates. Thus, the deceleration rule holds even when the closing velocity of the two vehicles is accelerating. Objects that pose a low risk of collision due to lateral separation will always decelerate the closing velocity and change their location azimuth as their passing becomes imminent.

The simulation data presented in FIGS. 2-5 are based on point targets. Real vehicles involve mass distributed over space that will reflect an area of RADAR and/or LADAR returns. The determination of azimuth changes with these areas, especially at short ranges, can be accomplished by examining the behavior of the returns of the most proximate points. It is important for a collision avoidance system to continuously assess collision risk of the most proximate points as these are the points that will be encountered first in any collision. However, the collision risk of more distal points is also assessable and may be treated as separate targets relative to the motions of the host. For example, a spinning target automobile may initially present with proximate points that could be receding from the host while more distal points are swinging into a collision with the host.

The major value of assessing the first and second derivatives of range under constant or changing azimuth conditions is in the predictive power they provide to the collision avoidance decisions. This method applies to both static and moving objects, objects with transient or consistent relative trajectories, objects with curvilinear or linear relative trajectories, objects with constant or varying relative velocities, and objects at all relative azimuths and relative ranges that are detectable by the host sensors. This method applies to all sensors that can detect range and azimuth, such as RADAR, LIDAR, and SONAR and is applicable to a 1-D geometry (as in conventional adaptive cruise control), a 2-D geometry (as in FIGS. 2-5), or a 3-D geometry when elevation is added to azimuth as a conditional factor (as in an aerospace or underwater environment). Higher resolution sensors with respect to range and azimuth or elevation will improve the utility of this method.

In the present method, there is further no need to calculate velocities or locations of the host vehicle or of the obstacles in an external reference frame or to determine simultaneity of crossing particular points in space to predict a collision. There is no need to make assumptions about the future trajectory of the obstacle or of the host vehicle to assess the collision potential.

In order to determine the most risk-free maneuvers to avoid collisions, risk, by definition, must be quantified. By example, one quantification of risk using the logic of the present invention is as follows:

For each point (i) on the azimuth vector that contains a target return compute the collision risk potential (P):

$$P_{it}=\tan h(\text{risk_factor}*(\text{range_risk}+\text{azimuth_risk})) \quad [1]$$

Where risk_factor=$(\gamma*RV_t/R_t)$ where $\gamma$ is some positive constant range_risk=tan h$(0.5+RA_t/RV_t)$ when $RV_t>0.0$, else=0.0 azimuth_risk=tan h$(0.5+\Theta A_t/\Theta V_t)$ when $\Theta V_t>0.0$; else=1.0

$RV_t$=range velocity=$R_{t-1}-R_t$ $RA_t$=range acceleration=$RV_{(t,t-1)}-RV_{(t-1,t-2)}$ $\Theta V_t$=azimuth velocity=abs$(\Theta_{t-1}\Theta_t)$ $\Theta A_t$=azimuth acceleration=$(\Theta V_{(t-1,t-2)}-\Theta V_{(t,t-1)})$ $R_t$=range at time t and $\Theta_t$=target azimuth at time t.

In equation [1], all objects that are approaching (when $RV_t>0.0$) are assigned a risk that can range from 0.0 to 1.0, based on the relative behavior and locations of the detected objects. Objects that are receding are assigned a collision risk of 0.0.

The ratio of velocity to range $(RV_t/R_t)$ provides a risk factor that is proportional to velocity and inversely proportional to range. Due to this risk factor, the relative motion of distant objects will be less risky than the relative motion of nearby objects. Objects that have range but no range velocity will produce a risk factor of 0.0. The constant $\gamma$ provides a convenient means to change the sensitivity of the system to the range risk factor. Increasing $\gamma$ increases the range at which risk values will evoke an avoidance response. For systems that respond slowly, $\gamma$ should be increased relative to systems that respond quickly.

Indeed, $\gamma$ need not be constant, but may be adaptive with traffic conditions and radar visibility. For example it might be useful to decrease $\gamma$ with denser traffic or increase $\gamma$ with poorer visibility, poorer road conditions, or a more heavily loaded vehicle. The net effect of increasing $\gamma$ would be to increase stand-off distances. Risk assessments are updated for each detected object in the host vehicle's environment at the sampling rate of the RADAR or LIDAR sensor. Higher update rates for the RADAR or LIDAR sensors increase the reliability of the short-term risk assessments. At closer ranges, a higher update rate would improve safety as only seconds may separate moving vehicles. The collision avoidance function may use the risk assessments with the relative velocity and range information to determine the most critical targets to avoid and the most effective avoidance maneuvers to minimize total collision risk. In fact, it should be appreciated that a multitude of remote objects may be received and analyzed as described herein. The number of remote objects that can be tracked and the corresponding risk assessed is limited only by the sensor and processing capabilities of the system as described herein.

All approaching objects will present a positive range velocity $(R_{t-1}-R_t)$. Those objects whose relative approach velocities are increasing, increasing collision risk, will present with a positive acceleration $(RV_t-RV_{t-1})$. Those objects whose relative approach velocities are decreasing will present with negative accelerations, indicative of either a tangentially moving object or one that is slowing down while possibly sill on a collision course. Negative range acceleration will reduce risk. The hyperbolic tangent function (tank( )) constrains the sum to the interval +/−1.0.

The contribution to the risk equation of azimuth changes is considered only when there is azimuth change, i.e. when abs$(\Theta_{t-1}-_t)>0.0$.

In the absence of azimuth change the contribution is 1.0.

When azimuth changes are decelerating the risk contribution increases positive, while the contribution of azimuth accelerations is negative. The hyperbolic tangent of the sum of 0.5 and the ratio of azimuth acceleration to azimuth velocity provides a quantification of the contribution of azimuth changes within the range +/−1.0.

Absolute changes in azimuth are indicative of a tangentially moving object, however if the magnitude of these changes decreases over time, the risk of collision increases. Accelerating azimuth changes (negative difference between azimuth velocities at t−1 and at t) are indicative of objects moving more tangentially relative to the host, and thus of a lower collision risk.

The risk associated with any object at each azimuth may be accumulated and preserved over time according to:

$$\text{accumulated risk}_t=(\text{accumulated risk}_{t-1}+\text{risk}_t)/2 \quad [2]$$

The accumulated risk for each object provides a running average of the risk associated with that object over time, increasing the certainty of the risk estimate.

Figure 6:
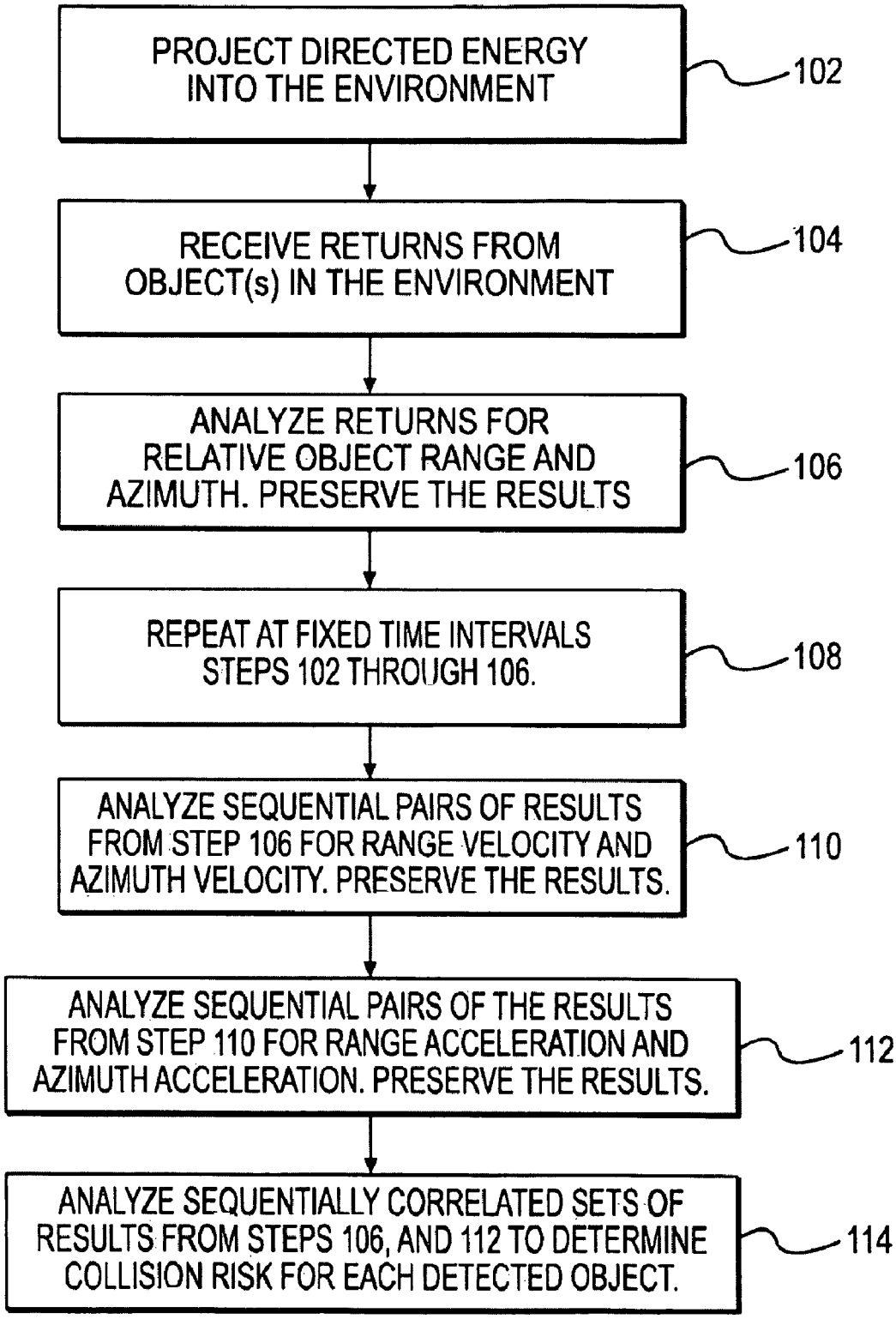
FIG. 6 is a flow chart showing the steps of the method disclosed herein.

With reference to FIG. 6, a representative method for detecting the likelihood of collision between a vehicle and a remote object using an active sensor includes the steps of transmitting a first signal at step 102; receiving a received signal that is indicates the presence of at least one remote object at step 104; analyzing the received signal at step 106 to determine an initial azimuth value for the remote object and to coincidentally determine a distance of the remote object. Steps 102 through 106 are repeated at predetermined time intervals at step 108.

Next, subsequent pairs of azimuth values and range values are analyzed to yield azimuth velocities and range velocities at step 110. Sequential pairs of the results from step 110 are further analyzed to compute range acceleration and azimuth accelerations and these values are preserved at step 112.

The aforementioned remote object range R, remote object range value velocity $RV_t$, remote object range value acceleration, remote object azimuth Θ, remote azimuth value velocity $\Theta V_t$ and remote azimuth value velocity $\Theta A_t$ that have been determined at steps 106, 110 and 112 are analyzed. To do this, a risk factor γ is chosen at according to the user desires, and a risk assessment P for the remote object is calculated using Equation [1] at step 114.

The above method is used to quantify a risk of collision P for each remote object for which sensor information is available, and the calculated risk P is displayed for the user (not shown), or stored by processor 808. If the calculated risk assessment value P is acceptable to the user, then no further action is required. If a calculated risk assessment value P is too high, however, than the user may be alerted via an audible or visual alarm.

Figure 7:
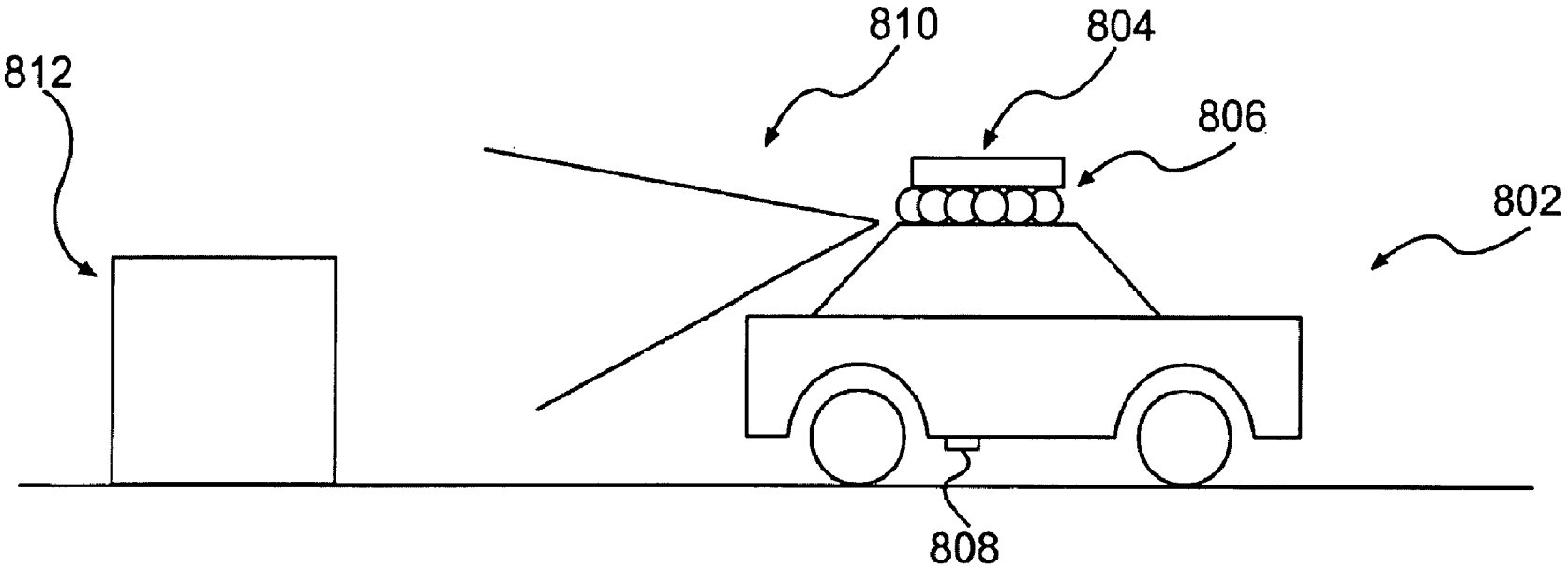
FIG. 7 shows a vehicle having an apparatus of the present invention.

Any sensor that provides range and azimuth data over time can be used with the present risk assessment methodology. Additionally, any moving vehicle can host the equipment and algorithms necessary to implement the present risk assessment methodology, including robots, automobiles, airplanes, boats, and space craft. For example, and with reference to FIG. 7, vehicle 802 includes a system having transmitter 804, receiver 806 and processor 808. The processor 808 causes transmitter 804 to emit a signal 810 (i.e., infrared signal, sonar, or other signal that can traverse a communications medium) toward a foreign object 812 that is reflected back toward receiver 806. The processor 808, which is located on an interior or even on an underside of the vehicle then interprets the received signal in accordance with the algorithms disclosed herein. After the received signal has been analyzed, the processor 808, if necessary to avoid a collision, then sends a signal to the vehicle's control mechanisms thereby causing the vehicle to avoid the foreign object 812 or sends a signal to a display with the vehicle to alert the operator to the approaching foreign object 812.

The present subject matter is not intended to be limited to the embodiments shown herein but is to be accorded the widest scope consistent with the principles and novel features disclosed herein. It will be understood that many additional changes in the details, materials, steps and arrangement of parts may be made by those skilled in the art within the principal and scope of the invention as expressed in the appended claims.

I claim:

1. An active collision detection apparatus mounted in a vehicle comprising:

a receiver that receives a received signal that is indicative of the presence of at least one remote object;

a processor that is configured to analyze said received signal to determine azimuth values $\theta_t$ at time t for said at least one remote object, wherein said azimuth value θ is an angle between a direction of travel of said vehicle and a line-of-sight to said at least one remote object, and to compute azimuth value velocities $\theta V_t$ and azimuth value accelerations $\theta A_t$ based on said azimuth values $\theta_t$;

said processor being further configured to analyze said received signal to determine initial range values $R_t$ at time t for said at least one remote object, wherein said range value R is a distance between said at least one remote object and said vehicle and to compute range value velocities $RV_t$ and range value accelerations $RA_t$ based on said range values $R_t$;

wherein said processor is configured to determine a risk assessment P of collision of said vehicle with said at least one remote object according to a predetermined algorithm $P_t$=tan h(risk_factor*(range_risk+azimuth_risk)), where risk factor=$(\gamma * RV_t/R_t)$ where γ is a scaling factor chosen according to the amount of said remote objects present around said vehicle, range_risk=tan h$(0.5+RA_t/RV_t)$ when $RV_t>0.0$ else=0.0, and azimuth_risk=tan h$(0.5+\theta A_t/\theta V_t)$ when $\theta V_t>0.0$; else=1.0; and, wherein said determined value of P indicates a degree of collision risk.

2. The collision detection apparatus as recited in claim 1 further comprising a passive sensor that receives emitted or reflected signals from said at least one remote object.

3. The collision detection apparatus as recited in claim 1 further comprising an active sensor that receives emitted or reflected signals from said at least one remote object.

* * * * *